US006273180B1

(12) United States Patent
Joshi et al.

(10) Patent No.: US 6,273,180 B1
(45) Date of Patent: Aug. 14, 2001

(54) HEAT EXCHANGER FOR PREHEATING AN OXIDIZING GAS

(75) Inventors: Mahendra L. Joshi, Darien; Arnaud Fossen, Justice; Harley A. Borders, Lombard, all of IL (US); Remi Pierre Tsiava, Grigny (FR); Olivier Charon, Chicago, IL (US)

(73) Assignees: L'Air Liquide, Societe Anonyme pour l'Etude et l'Eploitation des Procedes Georges Claude, Paris (FR); American Air Liquide, Walnut Creek, CA (US)

( * ) Notice: Subject to any disclaimer, the term of this patent is extended or adjusted under 35 U.S.C. 154(b) by 0 days.

(21) Appl. No.: 09/220,559

(22) Filed: Dec. 23, 1998

(51) Int. Cl.[7] ..... F28F 9/00; F28F 27/00; F28D 21/00

(52) U.S. Cl. ..... 165/11.1; 165/70; 165/158; 165/159

(58) Field of Search ..... 165/11.1, 70, 158, 165/159

(56) References Cited

U.S. PATENT DOCUMENTS 1,602,287 * 10/1926 Spencer ..... 165/70
1,794,200 * 2/1931 Pew, Jr. et al. ..... 165/70

(List continued on next page.)

FOREIGN PATENT DOCUMENTS

68524417U * 8/1985 (DE) .
270885 11/1985 (DE) .
0 328 414 8/1969 (EP) .
0328414 * 8/1989 (EP) .

OTHER PUBLICATIONS

Communication from European Patent Office, Application No. 99403137.5–2301 including Partial European Search Report, 6 pages (no date).

*Primary Examiner*—John K. Ford
(74) *Attorney, Agent, or Firm*—Jasper W. Dockrey; Brinks Hofer Gilson & Lione

(57) ABSTRACT

A heat exchanger useful for preheating oxidizing gases in a combustion process includes a shell having an inlet and an outlet for the ingress and egress of a first heat exchange fluid, such as a flue gas or preheated air. A first tube manifold couples an inlet end-cap to the first end of the shell. The inlet end-cap has an inlet for receiving a second heat exchange fluid, such as an oxidizing gas. In one embodiment, a second manifold couples an outlet end-cap to the second end of the shell. The second manifold includes an outlet tube therein extending from the second manifold through an outlet opening in the outlet end-cap. A tube bundle is disposed within the shell for transporting the oxidizing gas through the heat exchanger and is coupled to the first and second tube manifolds. The outlet tube collects oxidizing gas flowing through the tube bundle for discharge to a combustion system. The outlet end-cap is pressurized with an inert atmosphere and houses a chemical detector to detect the presence of oxidizing gas within the outlet end-cap.

22 Claims, 9 Drawing Sheets

U.S. PATENT DOCUMENTS

| | | | | |
|---|---|---|---|---|
| 1,948,550 | * | 2/1934 | Voorheis | 165/70 |
| 1,987,891 | * | 1/1935 | Cattanach | 165/70 |
| 3,114,415 | * | 12/1963 | Wintzer | 165/70 |
| 3,465,727 | * | 9/1969 | Tidball | 165/70 |
| 3,509,834 | * | 5/1970 | Rosenberg et al. . | |
| 3,561,378 | * | 2/1971 | Fabry . | |
| 3,850,231 | * | 11/1974 | Creek | 165/158 |
| 3,867,102 | * | 2/1975 | Csathy . | |
| 4,213,404 | * | 7/1980 | Spaulding . | |
| 4,460,331 | * | 7/1984 | Robson et al. . | |
| 4,475,340 | | 10/1984 | Tseng . | |
| 4,492,568 | | 1/1985 | Palz . | |
| 4,640,343 | * | 2/1987 | Dearden et al. . | |
| 4,691,769 | | 9/1987 | Flamm et al. . | |
| 4,771,707 | * | 9/1988 | Robson et al. . | |
| 4,858,681 | | 8/1989 | Sulzberger | 165/70 |
| 4,871,014 | * | 10/1989 | Sulzberger | 165/158 |
| 4,878,839 | * | 11/1989 | Wunning . | |
| 5,040,470 | * | 8/1991 | Lofton et al. . | |
| 5,323,849 | | 6/1994 | Korczynski, Jr. et al. . | |
| 5,526,580 | | 6/1996 | Zippe et al. . | |
| 5,578,102 | | 11/1996 | Alexander . | |
| 5,630,470 | * | 5/1997 | Lockwood, Jr. . | |
| 5,791,299 | * | 8/1998 | Matsuo et al. . | |
| 6,071,116 | * | 6/2000 | Philippe et al. | 432/29 |

* cited by examiner

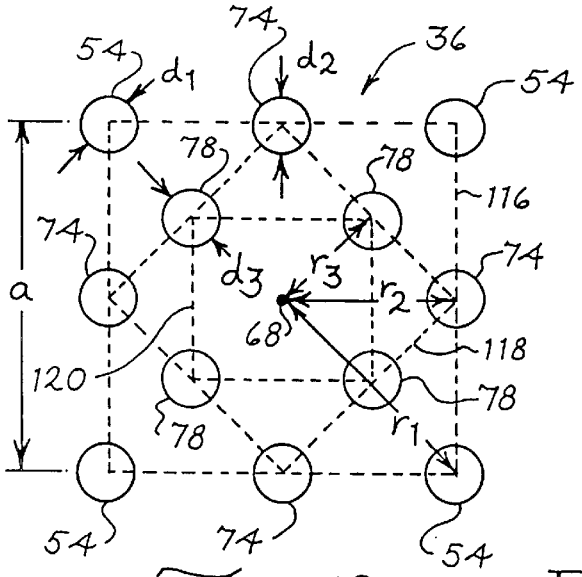
Fig. 12
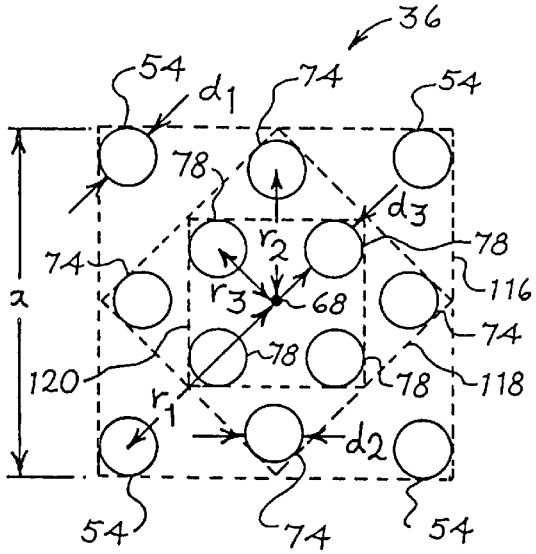
Fig. 13
Fig. 14
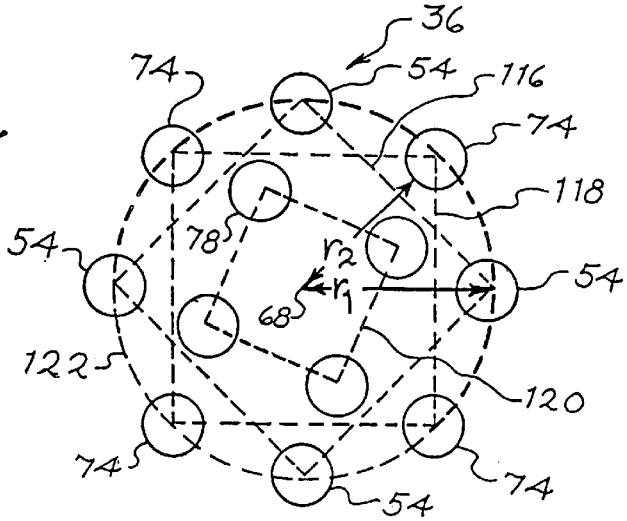

HEAT EXCHANGER FOR PREHEATING AN OXIDIZING GAS

Related subject matter is disclosed in commonly-assigned, patent application having Ser. No. 08/834,454 filed Apr. 15, 1997 now U.S. Pat. No. 6,071,116.

FIELD OF THE INVENTION

This invention relates, generally, to a heat exchange system for transferring heat from one heat transfer fluid to another, and more particularly, to a shell and tube heat exchange system that is capable of transferring heat to an oxidizer for subsequent use in a combustion process.

BACKGROUND OF THE INVENTION

Combustion systems are widely used by industry to provide heat to different substrates, such as steel, aluminum, cement, and the like. These load materials require considerable energy to undergo chemical and physical changes that are required to transform the load materials into more useful forms. Combustion systems typically require an oxidant in combination with a fuel to generate the large amount of energy needed to carry out chemical and physical transformation of the load materials. Typically, a hydrocarbon fuel is mixed with air or oxygen to release the combustion energy. During operation, the combustion systems generate fumes that take away some of the energy introduced by the combustion fuel. The fumes represent an energy loss mechanism that removes energy that otherwise should have been transferred into heating the load material. In this manner, substantial losses of energy can occur that impairs the efficiency of the combustion system and leads to energy waste. To reduce the energy loss, heat recovery systems are used that capture the heat of the flue gases and transfer it to another medium to perform useful work, as mechanical energy, electrical energy, chemical energy, and the like.

To improve the efficiency of the combustion system, the waste heat can be transferred back into the combustion fuel. Heat recovery systems are known that combine several solutions to enhance the efficiency of a combustion system. See for example, U.S. Pat. No. 4,492,568 to Palz and U.S. Pat. No. 4,475,340 to Tseng. In addition to heating the combustion fuel, systems are known in which the efficiency is improved by preheating the load material. For example, in the glass industry, a cullet preheating system on an oxygen-fuel combustion furnace transfers flue gases through a raining bed of cullet or batch pellets that are heated before entering the combustion furnace. See for example, U.S. Pat. No. 5,578,102 to Alexander and U.S. Pat. No. 5,526,580 to Zippe. Although the technique of preheating raw materials increases the combustion efficiency, such techniques are difficult to implement because of the extensive apparatus needed for handling large, bulky raw materials. The handling problems make such systems difficult to retrofit into existing combustion systems. Further, the engineering modifications necessary for installation of the heat recovery equipment can make the systems very expensive to build.

The preheating of natural gas is known technology for most combustion applications using heat recovery. It can be achieved through heat exchangers that recover the heat from the flue gases. Systems described in the U.S. Pat. Nos. 4,492,568 and 4,475,340 are applied in both combustion engines and industrial furnaces. These systems involve metallic parts that conduct the heat between the natural gas and the flue gases, and usually preheat the natural gas to temperatures below about 400° C. In heat recovery systems used to preheat natural gas, it is very important that structurally defective metallic components of the heat exchangers not be exposed to highly reducing conditions at elevated temperatures. The disassociated carbon from the natural gas can easily diffuse into structural defects, such as weld joints. The diffusion of the disassociated carbon can cause carburizing effects in the metal, and lead to case hardening and micro-crack formation in the welded joints.

To avoid potentially dangerous conditions arising from the formation of cracks in heat exchanger materials, heat exchangers can be built using non-metallic components. For example, a ceramic heat exchanger is described in U.S. Pat. No. 5,630,470 to Lockwood. Although avoiding the use of welded metals, materials such as ceramics are often fragile both mechanically and thermally, and they can fail in an unpredictable manner. In an environment where the heat transfer fluids may undergo abrupt temperature variations due to process settings, any failure of the ceramic material can trigger massive combustion in the heat recovery system. The potential danger associated with ceramic heat exchangers is shared by heat exchangers employing other materials, such as plastics and reinforced plastics, and the like. For example, U.S. Pat. No. 5,323,849 to Korezynski describes a corrosion resistant heat exchanger in which materials are selected for their corrosion and erosion resistance. However, it is highly unlikely that heat exchangers employing ceramic and plastic materials can be safely operated for preheating an oxidizer in a fuel combustion system.

The direct exchange of heat between waste flue gases and oxidizers used in a combustion system presents engineering challenges in the design of a safe and efficient heat exchange system. The breakdown or down time of such a heat exchange system can cause serious process interruption and increase production costs. Accordingly, a need exists for a heat exchanger that can preheat highly combustible fuels, such as hydrocarbon fuels, and oxidizers, such as oxygen, and the like, and that can be operated safely and efficiently.

SUMMARY OF THE INVENTION

In accordance with the invention, there is provided in one form a heat exchanger for preheating an oxidizing gas. The heat exchanger includes a shell having an inlet and an outlet for permitting the ingress and the egress of a first heat exchanger fluid. A tubular oxidizing gas pathway is disposed within the shell and it is configured to receive the oxidizing gas at an inlet and to discharge the oxidizing gas at an outlet. The diameter of the pathway increases along the direction of flow of the oxidizing gas, such that the tube diameter at the inlet is smaller than the table diameter at the outlet. The oxidizing gas pathway is constructed of metal that does not have any welded metallic surfaces exposed to the oxidizing gas.

BRIEF DESCRIPTION OF THE DRAWING

FIGS. 12–14 are schematic diagrams of tube arrangements in accordance with the invention.

DETAILED DESCRIPTION OF THE PREFERRED EMBODIMENTS

Figure 1:
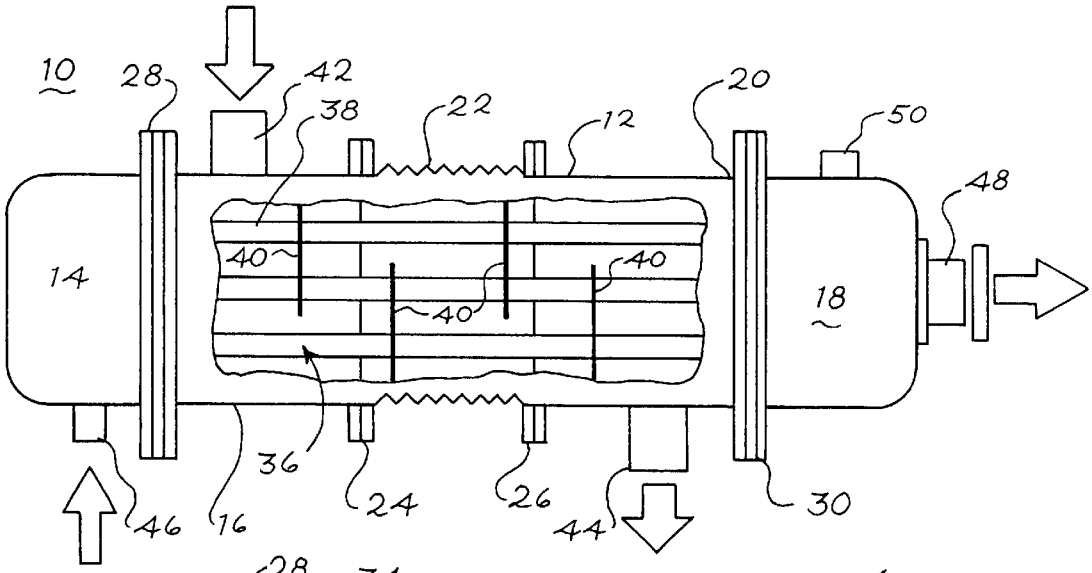
FIG. 1 is a side elevation view, partially broken away, of a heat exchanger in accordance with the invention.

Illustrated in FIG. 1 is a side elevation of a heat exchanger 10 arranged in accordance with a preferred embodiment of the invention. Heat exchanger 10 includes a shell 12 having an inlet end-cap 14 attached to a first end 16 of shell 12. An outlet end-cap 18 is attached to a second end 20 of shell 12. An expansion bellow 22 is coupled to shell 12 by bolted flanges 24 and 26 extending from shell 12 and expansion bellow 22. A second set of bolted flanges 28 and 30 couples inlet end-cap 14 to first end 16 of shell 12 and outlet end-cap 18 to second end 20 of shell 12, respectively. A cutaway portion of shell 12 reveals a tube bundle 36 housed within shell 12. Tube bundle 36 includes a plurality of parallel-spaced tubes 38 that traverse the interior of shell 12 from first end 16 to second end 20. A plurality of baffles 40 are arranged within shell 12 and support parallel-spaced tubes 38 of tube bundle 36.

In operation, a first heat exchange fluid, such as a flue gas, or hot medium carrying waste heat, or the like, is introduced to shell 12 through an inlet 42. The first heat exchange fluid traverses shell 12 through a pathway created by baffles 40 and exits shell 12 through an outlet 44. A second heat exchange fluid, such as an oxidizing gas, to be heated within heat exchanger 10 enters inlet end-cap 14 through an inlet 46. The second heat exchange fluid enters tube bundle 36 and is passed through parallel-spaced tubes 38, while being heated by the first heat exchange fluid passing through the shell side of heat exchanger 10. The second heat exchange fluid eventually passes from tube bundle 36 to outlet end-cap 18 and exits heat exchanger 10 through an outlet tube 48.

The term "oxidant" or "oxidizing gas," according to the present invention, means a gas with an oxygen molar concentration of at least 30%. Such oxidants include oxygen-enriched air containing at least 30% vol., oxygen such as "industrially" pure oxygen (99.5%) produced by a cryogenic air separation plant or non-pure oxygen produced by e.g. a vacuum swing adsorption process (about 88% by vol. $O_2$ or mole), or "impure" oxygen produced from air or any other source by filtration, adsorption, absorption, membrane separation, or the like, at either room temperature (about 25° C.) or in a preheated form.

As described in more detail below, outlet end-cap 18 is pressurized with an inert gas, such as argon, nitrogen, or mixtures thereof, or the like. In accordance with one aspect of the invention, a chemical detector 50 is positioned in outlet end-cap 18 or in shell 12, or in both, to detect the presence of the second heat exchange fluid within the interior cavity of outlet end-cap 18, or within shell 12. Chemical detector 50 is capable of detecting any leakage of the second heat exchange fluid from either tube bundle 36 or outlet tube 48. By prompt and precise leak detection of the second heat exchange fluid, the heat exchanger of the invention provides enhanced safety during heat exchange operations where dangerous oxidizing gases are being heated by heat exchanger 10. For example, where oxygen is introduced at inlet 46 at an initial temperature of about 21° C., and flue gas is introduced through inlet 42 at a temperature of about 1093° C., oxygen exits outlet tube 48 at a temperature of about 982° C. At this temperature, oxygen must be carefully handled to avoid contact with any oxidizable material. By configuring chemical detector 50 to detect the presence of oxygen, any leakage of oxygen from outlet tube 48 and tube bundle 36 can be quickly detected and heat exchanger 10 shut down to avoid dangerous operating conditions.

Figure 2:
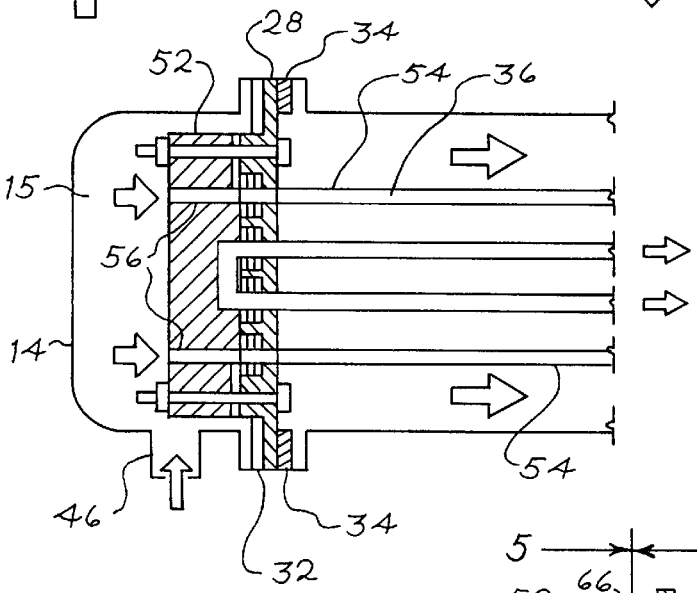
FIG. 2 is a cross-sectional view of the inlet portion of a heat exchanger in accordance with the invention.

A portion of heat exchanger 10 is illustrated in cross-section in FIG. 2. Inlet end-cap 14 is sealed to first end 16 of shell 12 by bolted flange set 28 and first and second gaskets 32 and 34 to form a first chamber 15. A segmented tube manifold 52 is positioned within inlet end-cap 14 to transfer the second heat exchange fluid from inlet end-cap 14 to tube bundle 36. The second heat exchange fluid enters inlet end-cap 14 through inlet 46. Inlet end-cap 14 directs the second heat exchange fluid into first pass tubes 54 of tube bundle 36 through openings 56 and segmented manifold 52.

Figure 3:
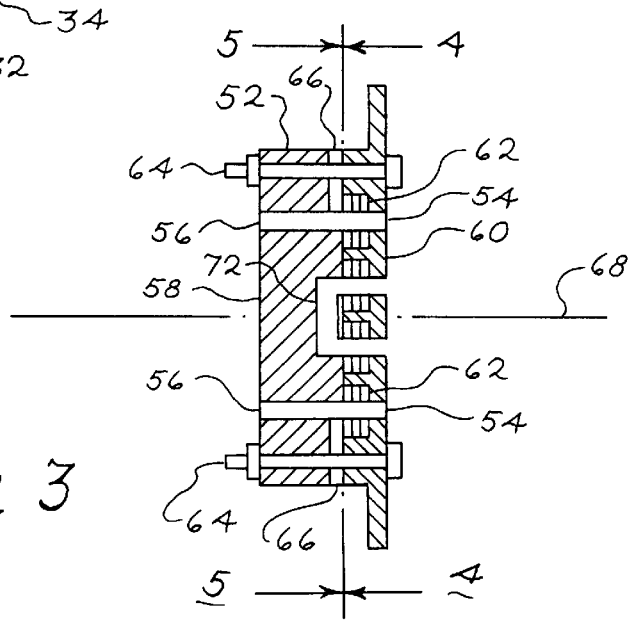
FIG. 3 is cross-sectional view of a segmented tube manifold arranged in accordance with the invention.

FIG. 3 illustrates an isolated cross-sectional view of segmented manifold 52. Segmented manifold 52 includes a first transverse segment 58 adjacent to a second transverse segment 60. First transverse segment 58 and second transverse segment 60 are adjacently aligned, such that a continuous fluid path is formed between openings 56 and first pass tubes 54.

Segmented tube manifold 52 is sealed to shell 12 by bolted flange set 28 and first and second gaskets 32 and 34. Fasteners 64 attach first transverse segment 58 to second transverse segment 60 and are sealed by an annular gasket 66. The general geometric arrangement of individual tubes within tube bundle 36, and their spatial relationship with respect to one another and with respect to segmented tube manifold 52 can be defined by a longitudinal axis 68.

Accordingly, second heat exchange fluid entering inlet end-cap 14 is directed through openings 56 and into first pass tubes 54 through segmented tube manifold 52.

Figure 4:
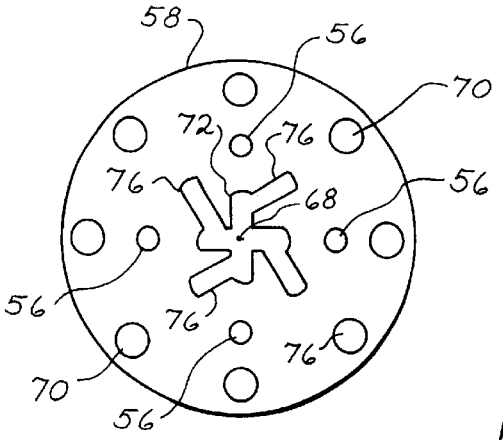
FIG. 4 is an elevational view of a first segment of the segmented tube manifold illustrated in FIG. 3.
Figure 5:
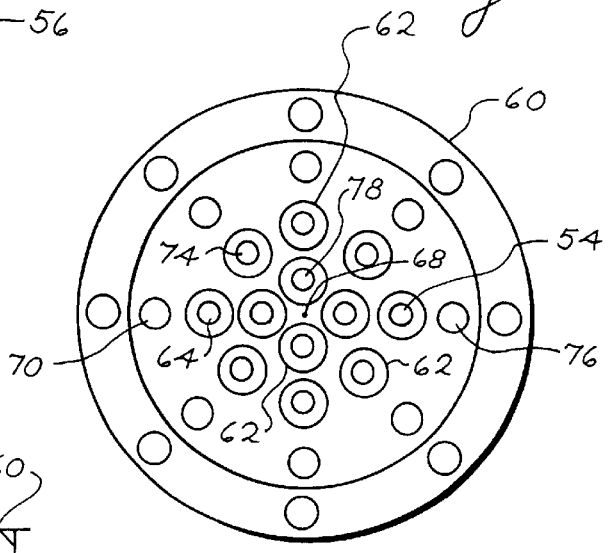
FIG. 5 is an elevation view of a second segment of the segmented manifold illustrated in FIG. 3.

An elevation view of first transverse segment 58 is illustrated in FIG. 4, and an elevational view of second transverse segment 60 is illustrated in FIG. 5. Openings 70 accommodate fasteners 64 and are arrayed around the periphery of first and second transverse segments 58 and 60. Openings 56 are arranged about a central plurality of passageways 72. Plurality of passageways 72 provide channels within first transverse segment 58 for receiving the second heat exchange fluid from second pass tubes 74 (shown in FIG. 5). Passageways 72 include a plurality of prongs 76 that extend outward from longitudinal axis 68. The apex of prongs 76 is located at a radial distance from longitudinal axis 68 that is equal to the radial distance of openings 56.

Referring to FIG. 5, flange 61 forms the peripheral portion of second transverse segment 60. Second transverse segment 60 also includes a plurality of bores 62 for receiving terminal ends of parallel-spaced tubes 38. Parallel-spaced tubes 38 are coupled to second transverse segment 60 in a concentric arrangement with respect to longitudinal axis 68. In the present embodiment, third pass tubes 78 are arranged about longitudinal axis 78 in close proximity thereto. First and second pass tubes 54 and 74 are arranged about third pass tubes 78, but at a greater radial distance from longitudinal axis 68. The elevational view also illustrates the alternating relationship between first pass tubes 54 and second pass tubes 74. Both sets of tubes are located equidistant from longitudinal axis 68 and are engaged with second transverse segment 60 by bores 62.

First transverse segment 58 and second transverse segment 60 are aligned so as to create fluid pathways for transferring the second heat exchange fluid between the first, second, and third pass tubes. For example, upon traversing second pass tubes 74, the heat exchange fluid enters passageways 72 and travels through prongs 76 toward longitudinal axis 68. Passageways 72 then reverse the direction of flow of the heat exchange fluid and direct the fluid into third pass tubes 78.

In the embodiment illustrated in FIG. 5, the radial relationship among the individual tubes within tube bundle 36 enables efficient heat transfer from the first heat exchange fluid flowing within shell 12 and the second heat exchange fluid flowing within tube bundle 36. A particular advantage of the present invention includes the placement of alternating first and second pass tubes on the outer periphery of tube bundle 36, and the third pass tubes near the center of tube bundle 36. This arrangement enables the introduction of relatively lower temperature heat exchange fluid into heat exchanger 10 near the outside walls of shell 12, while relatively hotter heat exchange fluid is contained within the third pass tubes near the center of shell 12. In addition to the heat transfer between the flue gases on the shell-side and the oxidizer within tubes, heat is also transferred by radiation between third pass tubes and first and second pass tubes 54 and 74. The preferred tube arrangement enables the hotter fluid within third pass tubes 78 to preheat the relatively colder fluid traversing first and second pass tubes 54 and 74. Accordingly, the heat transfer from the first heat exchange fluid to the second heat exchange fluid is carried out at high efficiency.

In addition to providing high heat exchange efficiency, tube bundle 36 also minimizes the pressure drop of the second heat exchange fluid flowing within tube bundle 36. This is accomplished by varying the tube diameter of the individual tubes within tube bundle 36. The overall fluid pressure drop within the tubes is reduced by using small diameter tubes for first pass tubes 54, slightly larger diameter tubes for second pass tubes 74, and still larger diameter tubes for third pass tubes 78. The gradual increase in tube diameter with the progression of fluid flow and with the radial distance from longitudinal axis 68 maintains a constant pressure drop within tube bundle 36 despite the volumetric expansion of the second heat exchange fluid as its temperature increases.

Those skilled in the art will appreciate that, although the invention is illustrated with an alternating tube arrangement between first and second pass tubes 54 and 74, the individual tubes within tube bundle 36 can be arranged in a progressively decreasing radial distance from longitudinal axis 68. Additionally, tube bundle 36 can be a single tube generally aligned with longitudinal axis 68. Accordingly, the present invention contemplates a variety of tube arrangements and geometries to reduce fluid pressure drop, and to increase heat transfer efficiency.

Figure 6:
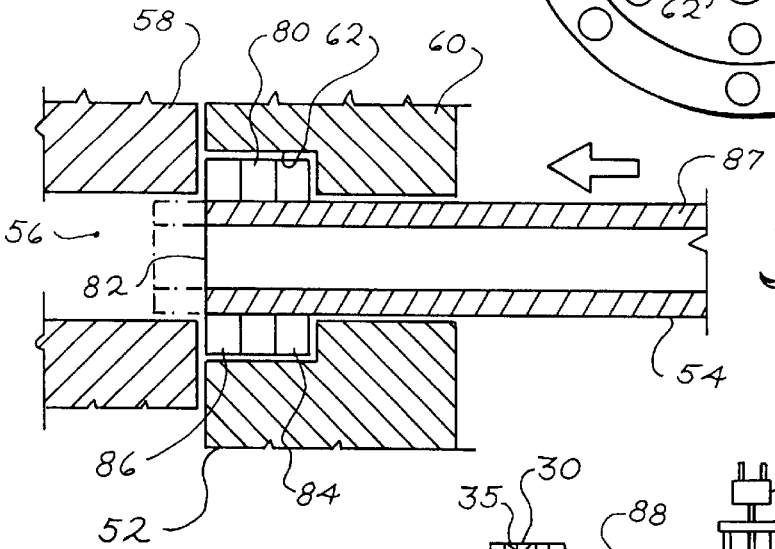
FIG. 6 is an enlarged cross-sectional view of a tube coupling arrangement in accordance with the invention.

The coupling of the individual tubes of tube bundle 36 to segmented tube manifold 52 is illustrated in FIG. 6. A flange 80 is located near a terminal end 82 of tube 54. A first tube gasket 84 and a second tube gasket 86 encircle tube 54 and reside adjacent to flange 80. Bore 62 and second transverse segment 60 accommodates flange 80 and first and second tube gaskets 84 and 86, such that tube 54 can longitudinally expand and contract without inducing stress within segmented tube manifold 52.

The floating tube coupling created by bore 62, flange 80, and first and second tube gaskets 84 and 86 provide enhanced operational safety of heat exchanger 10. By arranging flexible gaskets on either side of the tube flanges, the sliding or longitudinal floating action of the tubes within tube bundle 36 can occur as the tubes expand and contract with temperature changes. The double gasketing system insures proper sealing between the tubes and first and second transverse segments 58 and 60. Preferably, first tube gasket 84 is constructed of alumina-silica ceramic fiber to provide high-temperature gasketing near the interior regions of shell 12. Second tube gasket 86 is preferably an expansion gasket constructed of a metal, such as copper, or metal fibers and accommodates stress near the adjoining regions of first and second transverse segments 58 and 60. To insure safe operation, the inner surface of tube 54 can be lined with a lining 87. Preferably, lining 87 is a ceramic material, and more preferable a metallic oxide, such as aluminum oxide, zirconium oxide, chromium oxide, yitrium oxide, and the like. Within the scope of the present invention, many different rare earth oxides will provide protection to tube 54 from attack by oxidants comprising oxygen. Accordingly, all such rare earth oxides can provide a suitable material for lining 87.

Figure 7:
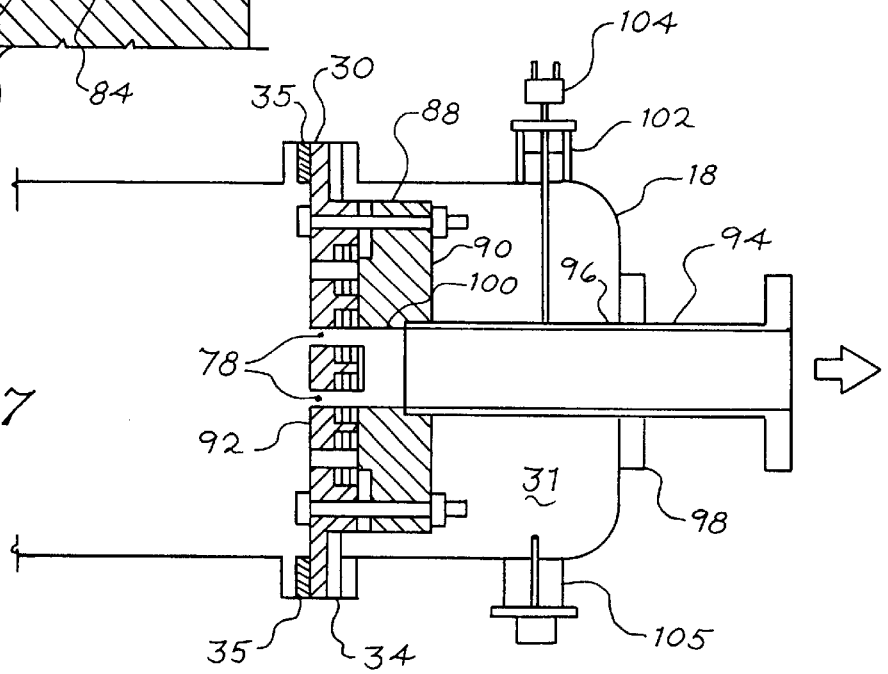
FIG. 7 is a cross-sectional view of an outlet end of a heat exchanger in accordance with the invention.

A cross-sectional view of the outlet side of heat exchanger 10 is illustrated in FIG. 7. A segmented manifold 88 is positioned within outlet end-cap 18 and sealed by bolted flange set 30 and gaskets 34 and 35 to form a second chamber 31. Segmented manifold 88 includes a first transverse segment 90 positioned adjacent to a second transverse segment 92. An outlet tube 94 is threaded and welded on exterior surface of first transverse segment 90. Outlet tube 94 extends through outlet end-cap 18 and exits outlet end-cap 18 through an opening 96. A sliding support flange 98 seals outlet tube 94 within opening 96. This is accomplished using high temperature O-rings or seals. The interior end of outlet tube 94 is engaged with first transverse segment 90 so as to collect the second heat transfer fluid exiting from third pass tubes 78. An opening 100 in first transverse segment 90 accommodates an end portion of outlet tube 94, and provides a collection point for heat transfer fluid from third pass tubes 78.

In accordance with the invention, second chamber 31 contains a gas that is different from the second heat exchanger fluid. In a preferred embodiment, second chamber 31 is pressurized with an inert gas, such as argon, nitrogen, and the like. Sliding support flange 98 and gasket 34 prevent the inert gas from escaping outlet end-cap 18. In a preferred embodiment, the inert gas is pressurized to a higher pressure than the second heat exchange fluid flowing within tube bundle 36 and outlet tube 94. The greater pressurization of the inert gas makes it more difficult for a leak to develop from segmented tube manifold 88. Another function of the inert gas within outlet end-cap 18 is to cool the components of heat exchanger 10 at the outlet side of the heat exchanger. This feature is important where the second heat exchange fluid is an oxidant comprising oxygen that has been heated to a high temperature by heat exchanger 10. Isolating the heat exchanger components in close proximity to the exiting high oxidizing fluid reduces the chances of unwanted spontaneous combustion occurring near the exit point of the heat exchanger.

A further safety feature of the invention is the sliding arrangement of outlet tube 94. The sliding arrangement allows outlet tube 94 to expand and contract as the temperature of the second heat exchange fluid changes. By allowing outlet tube 94 to move longitudinally within end-cap 18, compression stress between outlet tube 94 and segmented tube manifold 88 is minimized. To accommodate longitudinal motion, sliding support flange 98 permits outlet tube 94 to slide back and forth as changing temperature causes outlet tube 94 to expand and contract.

In one embodiment, outlet end-cap 18 is further equipped with an instrument port 102. Instrument port 102 is configured in such a way as to support a variety of different instruments for monitoring the performance of heat exchanger 10. For example, instrument port 102 can accommodate a thermocouple 104 for monitoring the outlet temperature of the second heat exchange fluid. Additionally, instrument port 102 can accommodate a chemical analyzer, such as a residual gas analyzer, and the like. For analyzing the chemical components of gases within second chamber 31. As previously described, an additional instrument port can also be positioned in shell 12. Further, an additional instrument port 105 can be mounted to end cap 18.

The chemical analyzer can be configured to detect the presence of the second heat exchange fluid within outlet end-cap 18, and/or within shell 12. By continuously monitoring for particular chemical species within the second heat exchange fluid, any leakage from within the tubes of tube bundle 36 and outlet tube 94 can be readily detected. By providing for precise leak detection within heat exchanger 10, the heat exchanger can be employed to heat oxidizing gases, while maintaining a margin of safety during heat exchange operations. If an oxidizing species, such as oxygen, is detected within end-cap 18, heat exchanger 10 can be quickly shut down to avoid spontaneous combustion.

To provide increased operating safety, electronic monitoring and display devices (not shown) can be used to notify an operator in the event of equipment failure of the chemical analyzer or temperature monitoring device. In addition to monitoring for equipment failure, the electronic device can also alert an operator to perform periodic maintenance on the leak detection and temperature monitoring devices. For example, the operator can be alerted to periodically replace the chemical sensor to insure that the sensor will always be fully operational.

Figure 8:
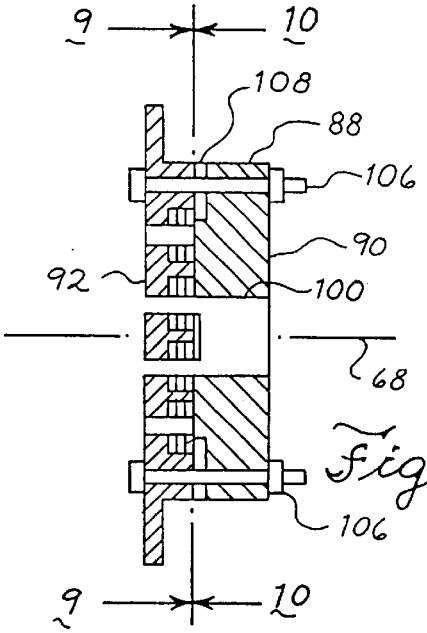
FIG. 8 is a cross-sectional view of a segmented tube manifold arranged in accordance with the invention.

A cross-sectional view of segmented tube manifold 88 is illustrated in FIG. 8. Fasteners 106 coupled first transverse segment 90 to second transverse segment 92 and a seal is provided by an annular gasket 108. First and second pass tubes 54 and 74 are engaged by second transverse segment 92 in the same manner as with segmented tube manifold 58.

Figure 9:
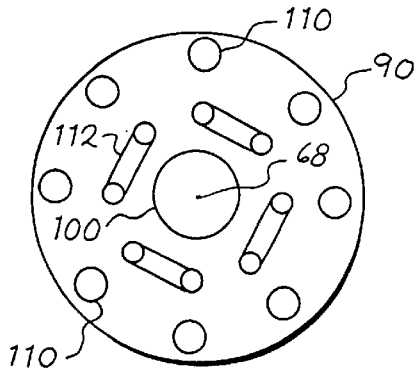
FIG. 9 is an elevation view of one segment of the segmented tube manifold shown in FIG. 8.
Figure 10:
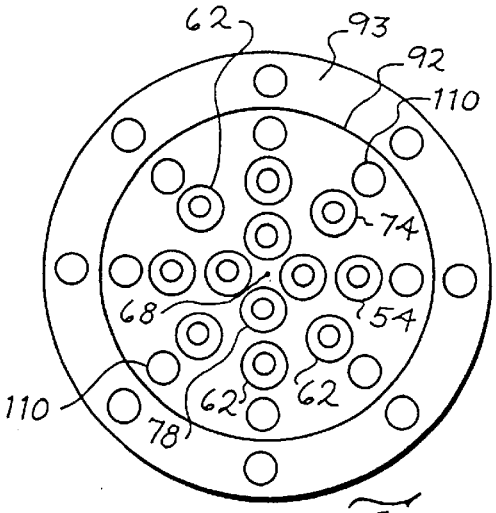
FIG. 10 is an elevation view of another segment of the segmented manifold shown in FIG. 8.

An elevation of first transverse segment 90 is illustrated in FIG. 9 and second transverse segment 92 is illustrated in FIG. 10. A plurality of openings 110 are arranged at the periphery of first and second transverse segments 90 and 92 to accommodate fasteners 106. A plurality of passageways 112 are arranged about opening 100 and provide for a fluid transfer between first pass tubes 54 and second pass tubes 74. Passageways 112 are coupled with the first and second pass tubes, such that the flow of the second heat exchange fluid from first pass tubes 54 enters a passageway and flows to a second pass tubes 74, reversing direction in the process. The opening 100 is aligned with third pass tubes 78, such that the second heat exchange fluid flowing through third pass tube 78 is collected and transferred to outlet tube 94.

Referring to FIG. 10, a flange 93 forms a peripheral portion of second transverse segment 92. The arrangement of bores 62 to receive the parallel-spaced tubes 38 of tube bundle 38 is similar to second transverse segment 60. In keeping with the geometric arrangement of the invention, first and second pass tubes 54 and 74 are received at a location distal from longitudinal axis 68, while third pass tubes 78 are received at a location proximal to longitudinal axis 68. The individual tubes of tube bundle 38 are engaged with second transfer segment 92 in the same manner as illustrated in FIG. 6. Preferably, both segmented tube manifold 52 and segmented tube manifold 88 are formed of thick alloy steel. Further, the tube manifolds can be coated with a metallic oxide ceramic material, such as alumina, zirconia, and the like.

Those skilled in the art will recognize the many design characteristics of the present invention provide for expansion and contraction of the various components in heat exchanger 10. For example, expansion bellows 22 provides shell 12 with the ability to longitudinally expand and contract during operation. Expansion bellow 22 accommodates the longitudinal expansion of parallel-spaced tubes 38 within shell 12. To select a proper expansion bellows, the effective longitudinal expansion of shell 12 is calculated and a commercially available bellows is selected to accommodate the necessary longitudinal expansion. Preferably, shell 12 is manufactured of a high-temperature alloy steel. Further, shell 12 can be lined with a ceramic coating to include both temperature and corrosion resistance. Baffles 40 within shell 12 must necessarily also accommodate longitudinal expansion. The optimal number of such baffles provides higher heat transfer efficiency and effectively reduces the overall length of heat exchanger 10.

Figure 11:
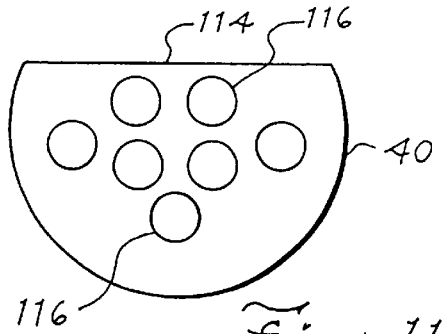
FIG. 11 is an elevational view of a baffle used in a heat exchanger in accordance with the invention.

An elevation of a baffle 40 is illustrated in FIG. 11. Baffle 40 includes a flat edge surface 114 to permit the flow of the first heat exchange fluid from one section of shell 12 to another. Baffle 40 contains a plurality of holes 116 to accommodate parallel-spaced tubes 38. Baffle holes 116 are machined to have slightly larger diameter than the individual tubes of tube bundle 38. The larger size of baffle holes 116 allows for longitudinal movement of shell 12 and tube bundle 36. By sizing baffle holes 116 to be slightly larger than parallel-spaced tubes 38, a floating-tube arrangement is formed within heat exchanger 10. Expansion gaskets adjacent to the flanges of parallel-spaced tubes 38 in conjunction with baffles 40 enable the tubes within shell 12 to longitudinally move independent of shell 12 and segmented tube manifolds 52 and 88.

The arrangement of the structural components of a heat exchanger formed in accordance with the invention provide the transfer of an oxidizing fluid, such as oxygen, air, air/oxygen mixtures, and the like, through the heat exchanger, while avoiding exposure of the oxidizing fluid to surfaces having welds or other structural weaknesses. Additionally, the heat exchanger described above effectively isolates the first and second heat exchange fluids, so as to avoid unwanted mixing of the fluids. In the event such unwanted mixing should occur, the heat exchanger of the invention provides detection means to quickly alert an operator to shut the heat exchanger down and avoid unwanted spontaneous combustion.

In accordance with the invention, further embodiments of tube arrangements for tube bundle 36 are illustrated in the schematic diagrams illustrated in FIGS. 12–14. The schematic diagrams display different arrangements of tubes by an end view of tube bundle 36. The geometric relationship of the first pass, second pass, and third pass tubes in each embodiment are depicted by the dashed lines provided in each schematic drawing.

Illustrated in FIG. 12 is a schematic diagram of a tube arrangement within two bundle 36 in accordance with a preferred embodiment of the invention. The centers of first pass tubes 54 are arranged at the corners of a first square pattern 116. The centers of second pass tubes 74 are arranged at the corners of a second square pattern 118 and intersect first square pattern 116 at the midpoint of each side of first square pattern 116. The centers of third pass tubes 78 are arranged at the corners of a third square pattern 120 and intersect the midpoints of each side of second square pattern 118. The geometric relationships among the first, second and third pass tubes can be characterized by equations (1) to (3) and inequalities (4) to (7).

$$r_1 = \frac{a}{\sqrt{2}} = \sqrt{2}\, r_2 \tag{1}$$

$$r_2 = \frac{a}{2} = \sqrt{2}\, r_3 \tag{2}$$

$$r_3 = \frac{a}{2\sqrt{2}} \tag{3}$$

$$\frac{r_1}{2} \geq \frac{d_1}{2} + \frac{d_3}{2} \tag{4}$$

$$r_2 \geq \frac{d_1}{2} + \frac{d_2}{2} \tag{5}$$

$$r_3 \geq \frac{d_2}{d_2} + \frac{d_3}{2} \tag{6}$$

$$r_2 \geq d_3 \tag{7}$$

Equation (1) sets forth a mathematical relationship for the distance ($r_1$) between the centers of first pass tubes 54 and longitudinal axis 68, and the length (a) of a side of first square pattern 116 and the distance ($r_2$) between the centers of second pass tubes 74 and longitudinal axis 68. Equation (2) sets forth a relationship between ($r_2$) and (a), and the distance ($r_3$) between the centers of third pass tubes 78 and longitudinal axis 68. Equation (3) sets forth a relationship between ($r_3$) and (a). The spacing between the tubes can also be specified by the inequalities (4) to (7), which relate the distances ($r_1$, $r_2$, $r_3$) to the diameter ($d_1$) of first pass tubes 54, the diameter ($d_2$) of second pass tubes 74, and the diameter ($d_3$) of third pass tubes 78.

The geometric relationships set forth by equations (1) (2) (3) and inequalities (4) to (7) describe a tube arrangement for tube bundle 36 that provide high heat transfer efficiency from both conductive and radiative heat transfer.

FIG. 13 illustrates a schematic diagram of a tube arrangement in accordance with another embodiment of the invention. In the embodiment shown in FIG. 13, first pass tubes 54, second pass tubes 74, and third pass tubes 78 are positioned tangential to first, second, and third square patterns 116, 118, and 120, respectively. The geometric relationship between the tubes in tube bundle 36 and longitudinal axis 68 can be expressed by equations (8) to (10) and inequalities (11) to (14).

$$\frac{a}{2} = \frac{d_2}{2} + \frac{r_1}{\sqrt{2}} \tag{8}$$

$$\frac{a}{2\sqrt{2}} = \frac{d_2}{2} + \frac{r_2}{\sqrt{2}} \tag{9}$$

$$\frac{a}{4} = \frac{d_3}{2} + \frac{r_3}{\sqrt{2}} \tag{10}$$

$$r_2 - r_3 \geq \frac{d_1}{2} + \frac{d_3}{2} \tag{11}$$

$$r_1^2 + r_1^2 - \sqrt{2}\, r_1 r_2 \geq \left(\frac{d_1 + d_2}{2}\right)^2 \tag{12}$$

$$r_2^2 + r_3^2 - \sqrt{2}\, r_2 r_3 \geq \left(\frac{d_2 + d_3}{2}\right)^2 \tag{13}$$

$$\frac{r_3}{\sqrt{2}} \geq d_3 \times \frac{1}{2} \tag{14}$$

Equation (8) relates the length (a) of a side of first square pattern 116 to the diameter ($d_1$) of first pass tubes 54, and to the distance ($r_1$) between the centers of first pass tubes 54 and longitudinal axis 68. Equation (9) relates (a) to the diameter ($d_2$) of second pass tubes 54 and to the distance ($r_2$) between the centers of second pass tubes 74 and longitudinal axis 68. Equation (10) relates (a) to the diameter ($d_3$) of third pass tubes 78 and the distance ($r_3$) between the centers of third pass tubes 78 and longitudinal axis 68. The inequalities (11) to (14) establish the spacing relationships based on the previously described parameters.

Yet another embodiment of a tube arrangement of tube bundle 36 appears in the schematic diagram illustrated in FIG. 14. In similarity with the preferred embodiment of FIG. 12, the centers of first pass tubes 54 are aligned with the corners of first square pattern 116. Also, the centers of second pass tubes 74 are aligned with the corners of second square pattern 118. Further, the centers of third pass tubes 78 are aligned with the corners of third square pattern 120. Additionally, the centers of both first pass tubes 54 and second pass tubes 74 lie on a circular pattern 122. A comparison between the embodiment shown in FIG. 14 and the embodiment shown in FIG. 5 illustrates the similar relationship of the radial distance between the centers of first and second pass tubes 54 and 74, and longitudinal axis 68. The embodiment illustrated in FIG. 14 differs with that illustrated in FIG. 5 in that the centers of third pass tube 78 are rotated 45 degrees relative to their position in the embodiment of FIG. 5.

All of the illustrated embodiments of tube arrangements for tube bundle 36 provide the beneficial radiative heat transfer associated with placing the hotter third pass tubes near longitudinal axis 68, while removing first and second pass tubes to a greater distance from longitudinal axis 68. Each illustrated embodiment offers a different arrangement of the tubes within tube bundle 36, and each embodiment provides an optimum packing density, while maintaining high efficiency heat transfer. Maintaining a high tube packing density serves to reduce the overall size of heat exchanger 10. Additionally, the illustrative embodiments accommodate the variation in diameter between first pass, second pass, and third pass tubes 54, 74, and 78. The larger diameter of third pass tube 78 relative to second pass tube 74 and first pass tubes 54 requires precise spacing conditions to achieve an optimal packing density. Those skilled in the art will appreciate that other alternatives are possible for arranging the tubes of tube bundle 36, and those arrangements are contemplated by the present invention.

Figure 15:
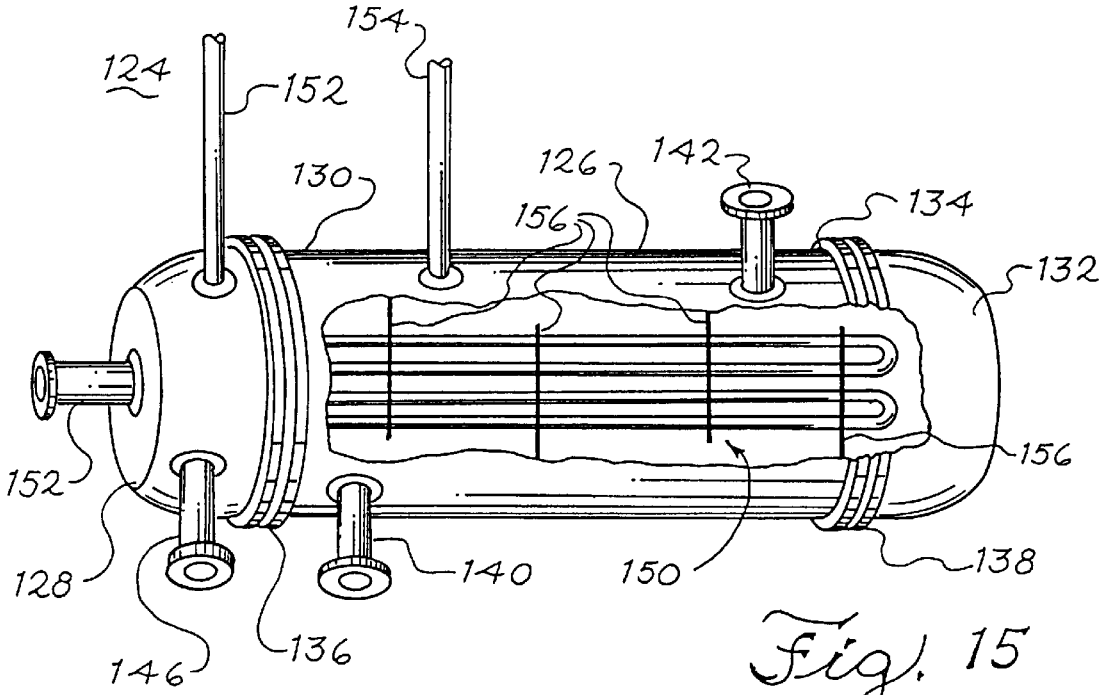
FIG. 15 is an elevation view, partially broken away, of a U-tube heat exchanger in accordance with the invention.

Although the multi-pass heat exchanger described above fully addresses the advantages of the present invention, those skilled in the art will recognize that other kinds of heat exchangers can be used to preheat an oxidizer for use in a combustion system. For example, U-tube heat exchangers can also be used to preheat oxidizers in a combustion system. Illustrated in FIG. 15 is an elevational view of a U-tube heat exchanger 124 arranged in accordance with the invention. U-tube heat exchanger 124 includes a shell 126 having an inlet/outlet end-cap 128 attached to a first and 130 of shell 126. A cover 132 is attached to a second end 134 of shell 126. A first bolted flange set 136 attaches inlet/outlet end-cap 128 to first and 130 of shell 126, and a second bolted flange set 138 attaches cover 132 to second end 134 of shell 126. Shell 126 includes an inlet 140 to permit the ingress of a first heat exchange fluid, such as a flue gas, and the like, and an outlet 142 to discharge the first heat exchange fluid from U-tube heat exchanger 124. Inlet 146 permits the ingress of a second heat exchange fluid, such as an oxidizer comprising oxygen, at inlet/outlet end-cap 128 and is coupled to a U-tube bundle 150 longitudinally disposed within shell 126. An outlet tube 152 extends from inlet/outlet end-cap 128 and permits the discharge of the second heat exchange fluid from U-tube heat exchanger 124. A first instrument port 152 extends through inlet/outlet end-cap 128, and a second instrument port 154 extends through shell 126. A plurality of baffles 156 support tube bundle 150 within shell 126.

Figure 16:
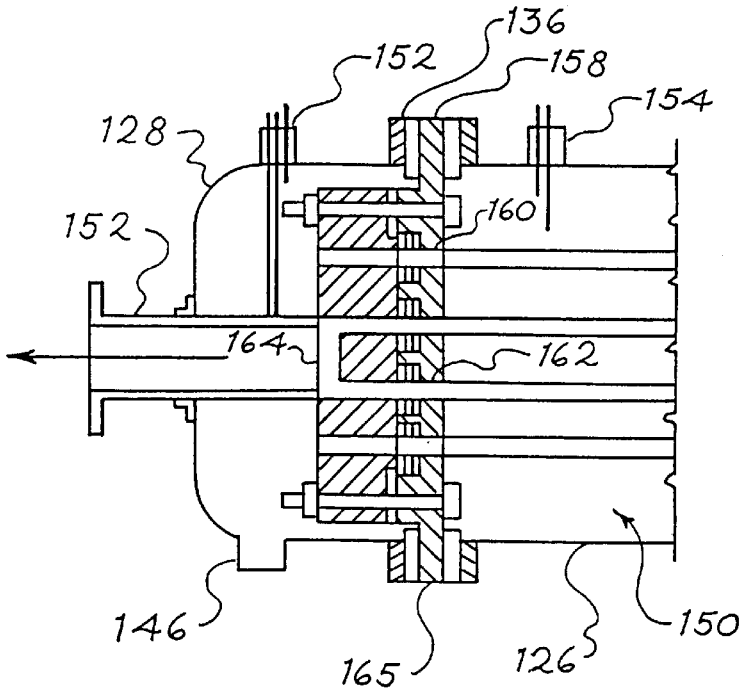
FIG. 16 is a cross-sectional view of an inlet/outlet portion of a U-tube heat exchanger in accordance with the invention.

A cross-sectional view of inlet/outlet end-cap 128 is illustrated in FIG. 16. A segmented tube manifold 158 is positioned within inlet/outlet end-cap 128 to transfer the second heat exchange fluid from inlet/outlet end-cap 128 to tube bundle 150. The second heat exchange fluid enters segmented tube manifold 158 through openings 160 and 162. Outlet tube 152 is coupled to an opening 164 and threaded into segmented tube manifold 158. Opening 164 collects the second heat exchange fluid discharging from tube bundle 150 and transfers the fluid to outlet tube 152. A flange 165 of segmented tube manifold 158 is secured by bolted flange set 136. Instruments for monitoring the interior temperature and for monitoring for the presence of constituents, such as oxygen, are mounted in first and second instrument ports 152 and 154.

Figure 17:
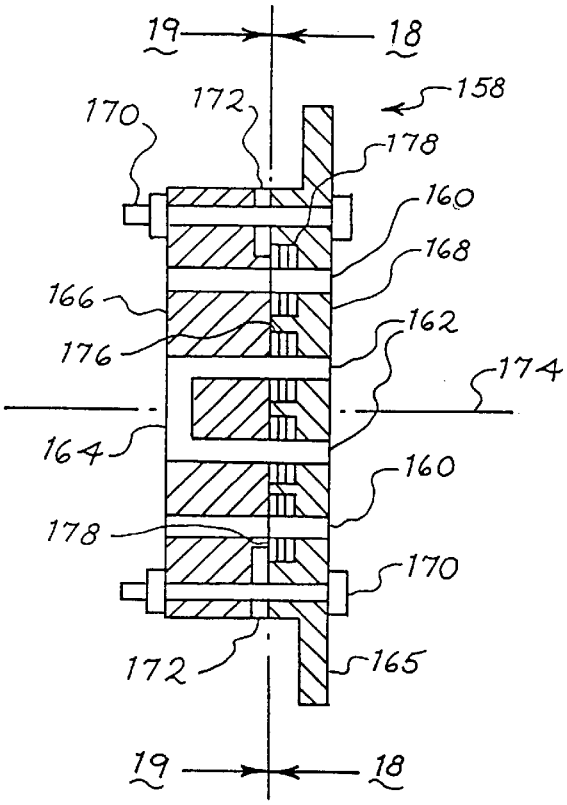
FIG. 17 is a cross-sectional view of a segmented U-tube manifold in accordance with the invention.

An isolated view of segmented tube manifold 158 is illustrated in FIG. 17. In similarity with previously described embodiments of the invention, segmented tube manifold 158 includes a first transfer segment 166 and a second transfer segment 168. First and second transfer segments 166 and 168 are aligned, such that fluid passageways are created by openings 160 and 162. First and second transfer segments 166 and 168 are attached by fasteners 170 and sealed by a gasket 172. Flange 164 extends from the periphery of first transfer segment 166 and cooperates with first bolted flange set 136 to secure segmented tube manifold 158 within shell 126. In similarity with the previous embodiment, the general geometric arrangement of individual tubes within tube bundle 150, and their spacial relationship with respect to one another and with respect to segmented tube manifold 158, can be defined by a longitudinal axis 174. In the U-tube embodiment of the invention, segmented tube manifold 158 directs the flow of the second heat exchange fluid both to and from inlet/outlet end-cap 128. To transfer the heat exchange fluid from the shell to the end-cap and out of the heat exchanger, opening 164 collects the second heat exchange fluid that has traversed to bundle 150 and now has an elevated temperature. The tubes within tube bundle 160 are secured within segmented tube manifolds 158 by flanges 176 and gaskets 178 encircling the perimeter of each tube and positioned on both sides of flanges 176.

Figure 18:
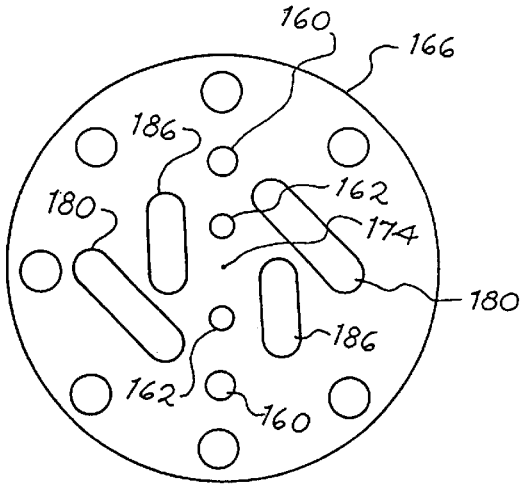
FIG. 18 is an elevation view of a first segment of the segmented U-tube manifold illustrated in FIG. 17.
Figure 19:
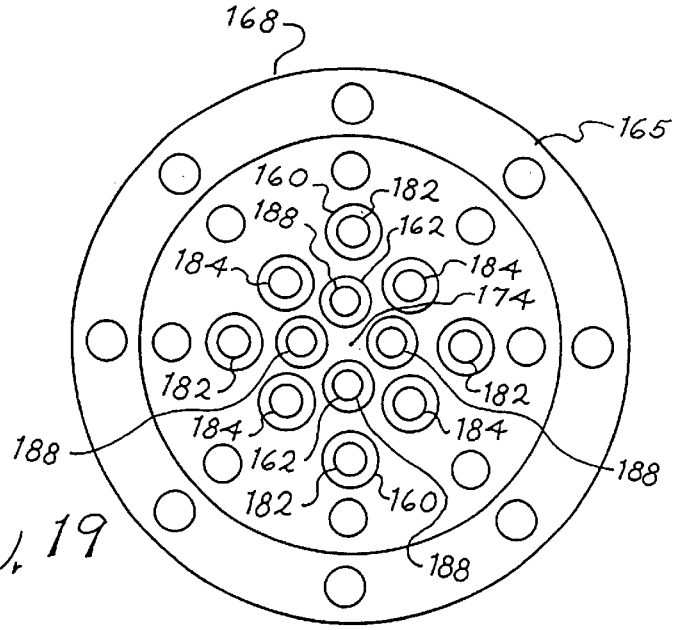
FIG. 19 is an elevational view of a second segment of the U-tube manifold illustrated in FIG. 17.

An elevational view of first transfer segment 166 is illustrated in FIG. 18, and an elevational view of second transverse segment 168 is illustrated in FIG. 19. The elevational views illustrate the arrangement of the individual tubes of tube bundle 150 and the manner in which the second heat exchange fluid is transferred between the individual tubes of bundle 150. Openings 160 and 162 are arranged about longitudinal axis 174. Slots 180 are machined into first transverse segment 166 and receive the second heat transfer fluid returning from first pass tubes 182 and transfer the second heat exchange fluid into second pass tubes 184. Correspondingly, slots 186 receive the second heat exchange fluid from second pass tubes 184 and transfer the fluid to third pass tubes 188. Upon traversing U-tube heat exchanger 124, openings 162 collect the second heat exchange fluid and transfer the fluid to collector opening 164 for discharge.

The elevational view illustrated in FIG. 19, displays the arrangement of first, second, and third pass tubes 182, 184, and 188 about longitudinal axis 174. In similarity with the previous embodiment the tubes are arranged, such that as the second heat exchange fluid traverses U-tube heat exchanger 124, the fluid is progressively transferred to tubes residing in close proximity to longitudinal axis 174. Also, in similarity with the previous embodiment, the diameter of the tubes increases with the length of traverse of the second heat exchange through U-tube heat exchanger 124. As in the previous embodiment, the diameter of third pass tubes 188 is greater than the diameter of second pass tubes 184, and the diameter of second pass tubes 184 is greater than the diameter of first pass tubes 182.

The tube arrangement illustrated in FIG. 19 is similar to that illustrated in FIG. 12, and represents a preferred arrangement of tubes within U-tube heat exchanger 124. However, those skilled in the art will recognize that the tube arrangement can be similar to that shown in FIGS. 10, 13, and 14. In the U-tube arrangement, the length of the individual tubes of first past tubes 182 is substantially the same. Also, the length of the individual tubes of second pass tubes 184 are substantially the same, and the length of the individual tubes of third pass tubes 188 are also substantially the same. However, to accommodate the U-tube arrangement of tube bundle 150 within shell 126, the overall length of first pass tubes 182 is greater than the overall length of second pass tubes 184. Also, the length of second pass tubes 184 is greater than the length of third pass tubes 188. In this manner, the bending of the tubes near cover 132 can be accomplished, while maintaining a relatively compact packing density.

Figure 20:
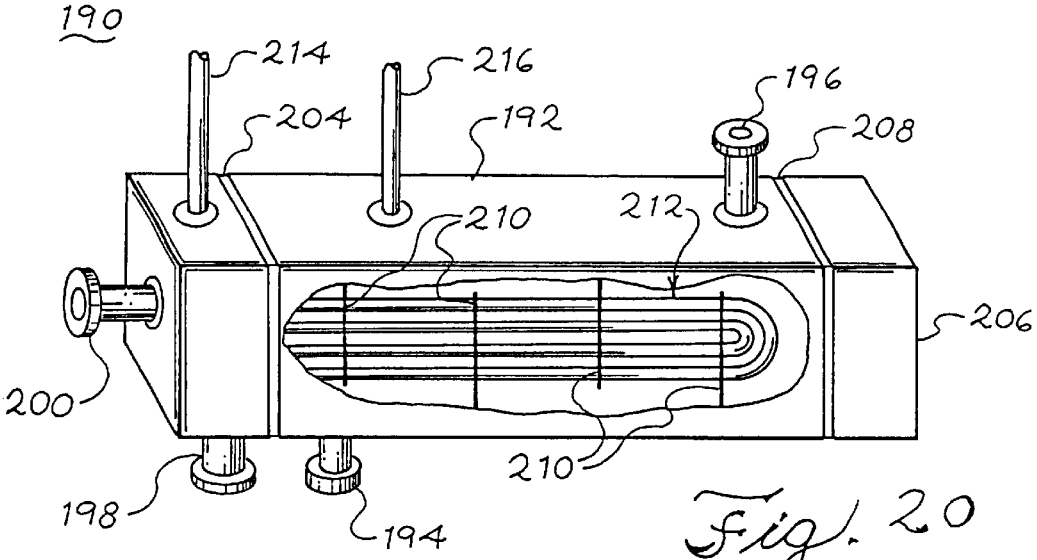
FIG. 20 is an elevational view, partially broken away, of a heat exchanger in accordance with another U-tube embodiment of the invention.

An elevational view of a U-tube heat exchanger 190 in accordance with another embodiment of the invention is illustrated in FIG. 20. U-tube heat exchanger 190 includes a shell 192 having flat sides. A first heat exchange fluid, such as a flue gas and the like, enters shell 192 through an inlet 194 and exits from an outlet 196. A second heat exchange fluid, such as an oxidant, enters U-tube heat exchanger 190 through an inlet 198 and exits through an outlet 200. An inlet/outlet end-cap 202 is attached to shell 192 by a bolted flange set 204, and a cover 206 is attached to shell 192 by a bolted flange set 208. A plurality of baffles 210 support a tube bundle 212 disposed within shell 192. A first instrument port 214 connects to inlet/outlet end-cap 202, and a second instrument port 216 connects to shell 192.

Figure 21:
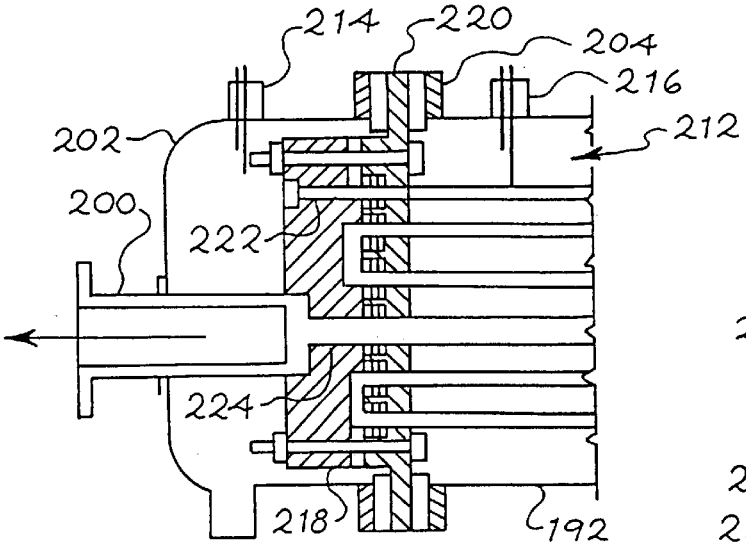
FIG. 21 is a cross-sectional view of an inlet/outlet portion of a U-tube heat exchanger in accordance with the invention.

A cross sectional view of inlet/outlet end-cap 202 is illustrated in FIG. 21. A segmented tube manifold 218 is positioned within inlet/outlet end-cap 202 and is secured to both the end-cap and shell 192 by a flange 220 and bolted flange set 204. An opening 222 in segmented tube manifold 218 transfers the second heat exchange fluid from inlet 198 to tube bundle 212. Also, an opening 224 collects the second heat exchange fluid returning from tube bundle 212 and transfers it to outlet tube 200.

Figure 22:
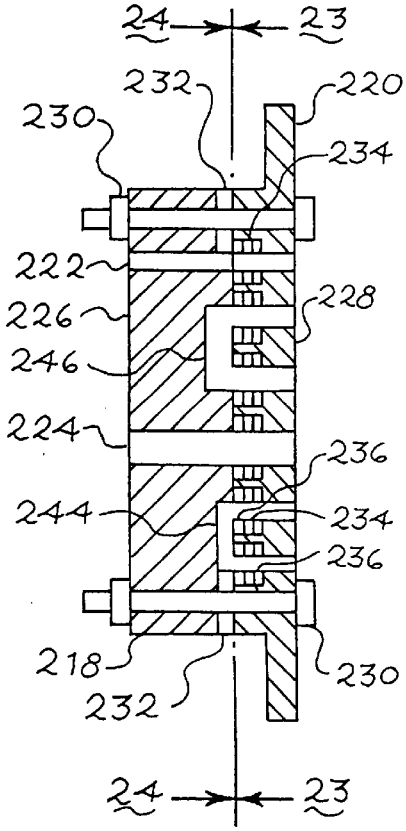
FIG. 22 is a cross-sectional view of a segmented U-tube manifold in accordance with the invention.

An isolated view of segmented tube manifold 218 is illustrated in FIG. 22. In similarity with the previous embodiments of the invention, a first transverse segment 226 is attached to a second transverse segment 228 by fasteners 230 and a gasket 232. The individual tubes of tube bundle 212 are secured in segmented tube manifold 218 by flanges 234 and gaskets 236 on either side of flanges 234. First and second transverse segments 226 and 228 are aligned so as to create fluid pathways for the entry of the second heat exchange fluid into two bundle 212 and for the discharge of the second heat exchange fluid through opening 224.

Figure 23:
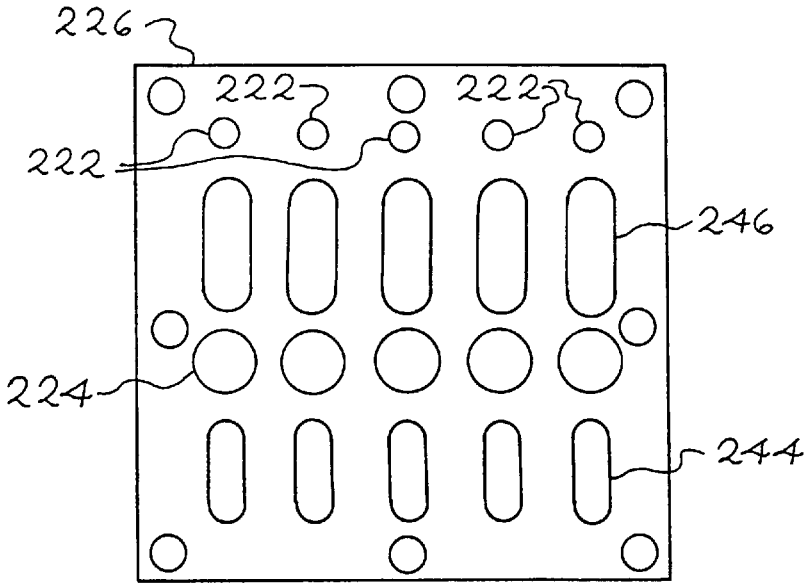
FIG. 23 is an elevational view of a first segment of the segmented U-tube manifold illustrated in FIG. 22.
Figure 24:
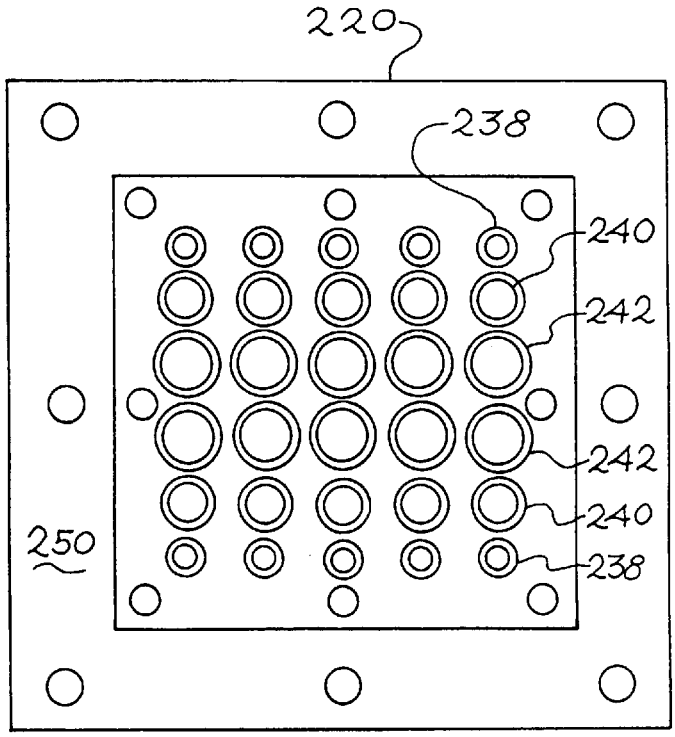
FIG. 24 is an elevational view of a second segment of the segmented U-tube manifold illustrated in FIG. 22.

An elevational view of first transverse segment 226 is illustrated in FIG. 23, and an elevational view of second transverse segment 228 is illustrated in FIG. 24. Segmented tube manifold 218 generally follows the flat-sided geometry of shell 192. The generally rectangular arrangement of first pass tubes 238, second pass tubes 240, and third pass tubes 242 corresponds with the generally flat-sided geometry of segmented tube manifold 218. Slots 244 and first transverse segment 226 collect the second heat exchange fluid from the return portion of first pass tubes 38 and transfer the fluid to the first portion of second pass tubes 240. Slots 246 collect the heat exchange fluid returning from the second portion of second pass tubes 240 and transfer the fluid to the first portion of third pass tubes 242. Opening 224 collect the heat exchange fluid returning from the second portion of third pass tubes 242 and transfer the fluid to outlet tube 200.

Figure 25:
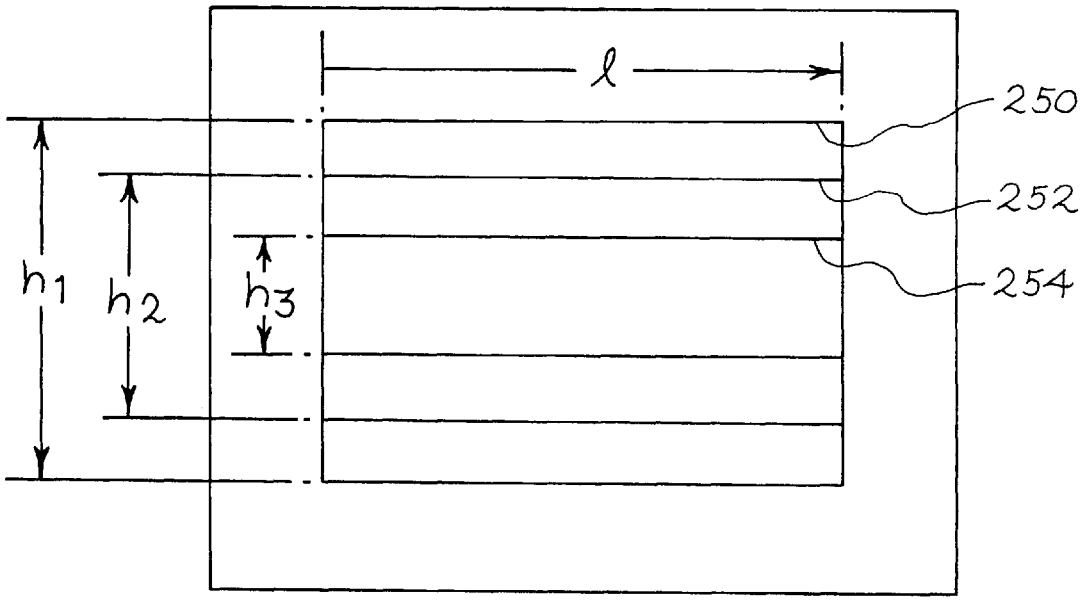
FIG. 25 is a schematic diagram of a tube pattern for a U-tube heat exchanger in accordance with the invention.

The general geometric arrangement of the individual tubes within tube bundle 212 can be characterized as generally following rectangular patterns. For example, first pass tubes 238 received the second heat transfer fluid through opening 222 in first transfer segment 226, and discharge the second heat transfer fluid into slots 244. A schematic diagram illustrating the geometric arrangement of the first, second and third pass tubes of tube bundle 212 is illustrated in FIG. 25. Generally, the centers of first pass tubes 238 are arranged along the topside and the bottom side of a first rectangle pattern 250. Also, the centers of second pass tubes 240 are arranged at the top side and bottom side of a second rectangular pattern 252, and the centers of third pass tubes 242 are arranged at the top and bottom sides of a third rectangular pattern 254. Each rectangular pattern is characterized by a length (l) and a height (h). In accordance with the generally flat edge geometry of segmented tube manifold 218, the height ($h_1$) of first rectangular pattern 250 is greater than the height ($h_2$) of second rectangular pattern 252. Also, the height ($h_2$) of second rectangular pattern 252 is greater than the height ($h_3$) of third rectangular pattern 254. By arranging the individual tubes of tube bundle 212 in generally rectangular patterns, a tight packing density can be maintained, while accommodating the bends of the tubes within tube bundle 212, and the generally flat-sided geometry of segmented tube manifold 218.

Figure 26:
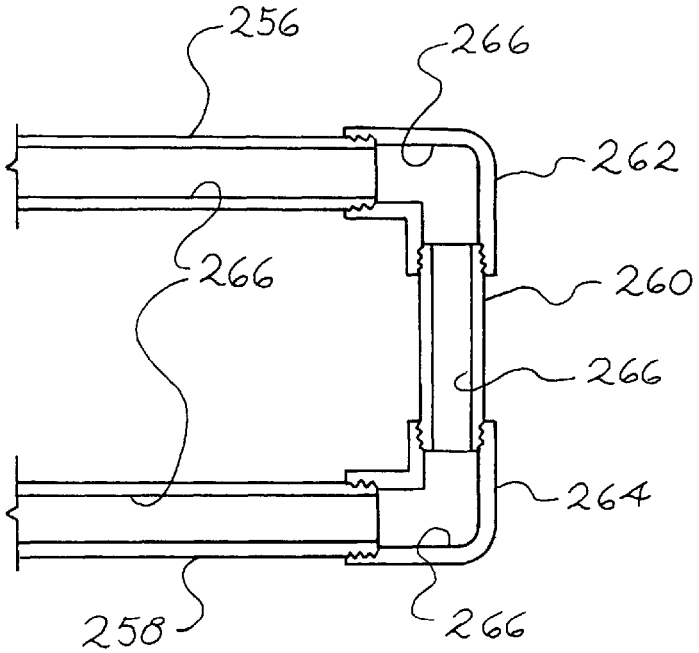
FIG. 26 is a cross-sectional view of a portion of an inner tube arranged in accordance with the invention.

Illustrated in FIG. 26 is a cross-sectional view of a portion of an inner tube arranged in accordance with the invention. In the embodiment illustrated, short tube segments are employed to construct a U-bend for a U-tube heat exchanger of the invention. By employing segments to construct the bend, all inner surfaces of the inner tube can be coated with a oxidant-resistant material, such as alumina, and the like. To construct the bend, a first tube segment 256 and a second tube segment 258 are coupled to a third tube segment 260 by L-shaped unions. A first union 262 couples first tube segment 256 to third tube segment 260, and a second union 264 couples second tube segment 258 to third tube segment 260. In accordance with the weld-free construction of the heat exchanger of the invention, each tube segment is joined to the L-shaped union by a non-weld coupling. For example, as illustrated in FIG. 26, the tube segments are threaded into first and second unions 262 and 264.

An oxidant-resistant lining 266 lines the inner surfaces of the tube segments and the L-shaped unions. In accordance with the invention the oxidant-resistant lining can be aluminum oxide, chromium oxide, a rare earth oxide, and the like. To further insure resistance to corrosion, the tube segments and unions are preferably constructed of an iron, chromium, and nickel (Ni—Fe—Cr) alloy. By employing non-weld couplings, corrosion-resistant metals, and oxidant resistant lining oxidizer fluid pathways are created within the heat exchanger of the invention, such that only weld-free surfaces are exposed to the oxidizer fluid. Although the foregoing description of tube construction materials and ceramic lining is illustrated with respect to the U-tube embodiment, the invention contemplates the use of such materials in the previously described embodiment and in all other embodiments of the invention.

The overall design of the heat exchanger in accordance with either of the illustrative shell and tube embodiments of the invention described above is such that the heat exchanger can be easily adapted and/or retrofitted into existing combustion systems, and chemical reactors and the like. Within the tube bundle, relatively cooler tubes are located on the periphery of the bundle, while relatively hotter tubes are located near the center of the tube bundle for higher heat exchanger effectiveness. Segmented baffles are positioned within the shell so as to produce a high shell-side heat transfer coefficient. The relatively cooler end-caps enable easy access to the interior of the heat exchanger for periodic maintenance and lower temperature operation produces longer useful life. Stress created by temperature induced expansion and contraction is minimized by the sliding discharge tube arrangement of the outlet tube within the outlet end-cap.

In a still further embodiment of the invention, the heat exchanger described herein can be operated in a reverse flow arrangement, where the oxidizer fluid is preheated to the shell side, and flue gas is introduced on the tube side. In this embodiment, the tubes are coated externally with ceramic coating to prevent high temperature oxidation, and an inner ceramic lining is applied to the inner surfaces of the shell.

In summary, the heat exchanger of the invention offers a weld-free, metallic, shell-and-tube heat exchanger for preheating an oxidizer. Non-welded construction is used throughout the heat exchanger and all materials are corrosion-resistant, high-temperature, oxygen-compatible materials. The materials include high-temperature specialty alloys, and commercial alloys coated with a ceramic layer, preferably containing both silica and chromia. The ceramic coatings can be applied by various deposition techniques, such as chemical vapor deposition, physical vapor deposition, plasma-spraying, diffused packed-cementations, and the like. The inner tubes and shell are constructed of heavy duty, thick metal that does not contain any weld surfaces, so that oxidizers and flue gases are not exposed to weld surfaces. The tube manifolds are constructed of robust material for effective multi-pass flow geometry, and provide positive sealing within the shell. The tube bundle is a floating-tube assembly with special flange and gasket seals for compensating longitudinal expansion and contraction within the shell.

Additionally, the heat exchanger of the invention is designed so that oxidizer leaking from within the heat exchanger can be contained first within the shell, then within the outlet end-cap. Leak detection is carried out through an instrument port located in the outlet end-cap, or alternatively, in the shell. The outlet end-cap is sealed, so that it can be pressurized with an inert gas, such as air or nitrogen, or mixtures thereof.

Further, a fluid pathway is provided within the shell of the heat exchanger that gradually increases in diameter along the direction of oxidizer fluid flow. This design effectively compensates for the pressure drop of the oxidizer fluid as it traverses the inner tubes of the heat exchanger.

Thus, it is apparent that there has been described, in accordance with the invention, a heat exchanger for preheating an oxidizer that fully provides the advantages set forth above. Although the invention has been described and illustrated with reference to specific embodiments thereof, it is not intended that the invention be limited to those embodiments. Those skilled in the art will recognize that variations and modifications can be made without departing from the spirit of the invention. For example, several temperature detection and chemical sensing devices can be placed at various locations in and around the heat exchanger. Additionally, different overall design shapes can be used, such as a multi-stage heat exchanger in which two or more shell and tube units are staged together to further increase the amount of heat transfer. It is therefore intended to include within the invention all such variations and modifications as fall within the scope of the appended claims and equivalents thereof.

What is claimed is:

1. A heat exchanger for preheating an oxidizing gas comprising:

a shell having an inlet and an outlet for respectively permitting the ingress and the egress of a first heat exchange fluid comprising a gas selected from the group consisting of flue gas and preheated air;

a first chamber having an inlet for receiving a second heat exchange fluid, the second heat exchange fluid comprising an oxidizing gas;

an innertube;

a first manifold configured to transfer the second heat exchange fluid from the first chamber to the inner tube;

a second chamber having an outlet tube extending through an opening therein;

a second manifold configured to transfer the second heat exchange fluid from the inner tube to the outlet tube, wherein the second chamber contains a gas different from the second heat exchange fluid; and a chemical detector configured to detect the presence of the oxidizing gas.

2. The heat exchanger of claim 1, wherein the inner tube comprises a multi-pass tube bundle disposed about a longitudinal axis within the shell, wherein the tube bundle includes a plurality of tubes arranged about the longitudinal axis, each tube characterized by a tube diameter, and wherein tubes positioned proximal to the longitudinal axis have a larger tube diameter than tubes positioned distal to the longitudinal axis.

3. The heat exchanger of claim 2, wherein the tube bundle includes first, second, and third pass tubes and, wherein first and second pass tubes are positioned distal to the longitudinal axis, and wherein third pass tubes are positioned proximal to the longitudinal axis.

4. The heat exchanger of claim 3, wherein the first manifold comprises:

a first transverse segment adjacent to a second transverse segment, the first transverse segment having a plurality of holes therethrough proximal to the longitudinal axis, and a plurality of passageway therein distal to the longitudinal axis, wherein the second transverse segment includes a first plurality of holes therethrough for receiving the first pass tubes, a second plurality of holes for receiving the second pass tubes, and a third plurality of holes for receiving the third pass tubes, and wherein the first transverse segment is aligned with the second transverse segment so as to form a fluid pathway from the first end-cap to the first pass tubes, and to form a reversing fluid pathway from the second pass tubes through the plurality of passageways and into the third pass tubes.

5. The heat exchanger of claim 3, wherein the second manifold comprises:

a first transverse segment adjacent to a second transverse segment, the first transverse segment having a first plurality of holes therethrough for receiving the first pass tubes, a second plurality of holes therethrough for receiving the second pass tubes, and a third plurality of holes therethrough for receiving the third pass tubes; and the second transverse segment having a plurality of passageways distal to the longitudinal axis and a hole therethrough proximal to the longitudinal axis for receiving the outlet tube, wherein the first transverse segment is aligned with the second transverse segment so as to form a reversing fluid pathway from the first pass tubes to the second pass tubes and to form a fluid pathway from the third pass tubes to the outlet tube.

6. The heat exchanger of claim 1 further comprising:

a first flange at an inlet end of the inner tube;

first and second gaskets adjacent to either side of the flange; and a coupling portion of the first manifold having a bore therein for receiving the first flange and the first and second gaskets.

7. The heat exchanger of claim 6, wherein the first gasket resides at a location distal to the first chamber and the second gasket resides at a location proximal to the first chamber, and wherein the first gasket is comprised of alumina-silica ceramic fiber, and the second gasket is comprised of a material selected from the group consisting of a metal fiber and copper.

8. The heat exchanger of claim 6 further comprising:

a second flange at an outlet end of the inner tube;

first and second gaskets adjacent to either side of the second flange; and a coupling portion of the second manifold having a bore therein for receiving the second flange and the first and second gaskets.

9. The heat exchanger of claim 6, wherein the first gasket resides at a location distal to the second chamber and the second gasket resides at a location proximal to the second chamber, and wherein the first gasket is comprised of alumina-silica ceramic fiber, and the second gasket is comprised of a material selected from the group consisting of a metal fiber and copper.

10. A heat exchanger for preheating an oxidizing gas comprising:

a shell having a first manifold at a first end and a second manifold at a second end, and having an inlet and an outlet for respectively permitting the ingress and egress of a first heat exchange fluid;

at least one tube disposed within the shell for transporting the second heat exchange fluid therethrough and engaging the first manifold and the second manifold at a first side of the first manifold and at a first side of the second manifold;

an inlet chamber adjacent to a second side of the first manifold, the inlet chamber having an opening for receiving a second heat exchange fluid, the second heat exchange fluid comprising an oxidizing gas;

an outlet chamber adjacent to a second side of the second manifold, the outlet chamber having an outlet opening therein;

an outlet tube coupled to the second side of the second manifold passing through the outlet opening in the outlet chamber and configured to receive the second heat exchange fluid, wherein the outlet chamber contains an inert atmosphere; and a gas analyzer in communication with the inert atmosphere and configured to detect the oxidizing gas.

11. The heat exchanger of claim 10, wherein the at least one tube comprises a multi-pass tube bundle disposed about a longitudinal axis within the shell, wherein the tube bundle includes a plurality of tubes arranged about the longitudinal axis, each tube characterized by a tube diameter, and wherein tubes positioned proximal to the longitudinal axis have a larger tube diameter than tubes positioned distal to the longitudinal axis.

12. The heat exchanger of claim 11, wherein first and second pass tubes are positioned distal to the longitudinal axis, and wherein third pass tubes are positioned proximal to the longitudinal axis.

13. The heat exchanger of claim 11, wherein the gas analyzer comprises an oxygen detector.

14. The heat exchanger of claim 10 further comprising a thermocouple mounted to an instrument port on the outlet chamber and configured to measure the temperature of the outlet tube.

15. The heat exchanger of claim 10, wherein the inert gas is selected from the group consisting of nitrogen, argon, and mixtures thereof.

16. A heat exchanger for preheating an oxidizing gas comprising:

a shell having an inlet and an outlet for permitting the ingress and egress of a gas selected from the group consisting of flue gas and preheated air;

at least one tube longitudinally disposed within the shell and configured to receive an oxidizing gas, an inlet manifold transversely positioned at an inlet end of the shell and configured to receive a first end portion of the at least one tube;

an outlet manifold transversely positioned at an outlet end of the shell and configured to receive a second end portion of the at least one tube;

an inlet end-cap positioned around the segmented inlet manifold and coupled to the inlet end of the shell; and an outlet end-cap having an axial opening therein, the end-cap positioned around the segmented outlet manifold and sealed to the outlet end of the shell;

an outlet tube partially inserted into an opening in the segmented outlet manifold and passing through the axial opening of the outlet end-cap, wherein the outlet tube is in communication with the at least one tube;

an inert atmosphere within the outlet end-cap;

means in communication with the inert atmosphere for detecting the presence of the oxidizing gas within the inert atmosphere; and means mounted to the outlet end-cap for measuring the temperature of the outlet tube.

17. The heat exchanger of claim 16 further comprising an expansion bellows integral with the shell.

18. The heat exchanger of claim 16, wherein a tube bundle is longitudinally disposed within the shell, and wherein the tube bundle includes a plurality of parallel spaced tubes.

19. The heat exchanger of claim 18, wherein the plurality of parallel-spaced tubes have inner tube walls of iron nickel chromium alloy lined with a ceramic material, and wherein the oxidizing gas comprises oxygen.

20. The heat exchanger of claim 18, wherein the plurality of parallel-spaced tubes comprise first pass tubes, second pass tubes, and third pass tubes, and wherein the first and second pass tubes are alternatingly arranged about a longitudinal axis at a first radial distance, and wherein the third pass tubes are arranged about the longitudinal axis at a second radial distance, and wherein the first radial distance is greater than the second radial distance.

21. The heat exchanger of claim 20, wherein each of the first, second, and third pass tubes are characterized by a diameter, and wherein the diameter of the first pass tubes is less than the diameter of the second pass tubes, and wherein the diameter of the second pass tubes is less than the diameter of the third pass tubes.

22. The heat exchanger of claim 16, wherein the means for measuring the temperature comprises a thermocouple.

* * * * *